US006933935B2

(12) United States Patent
Sagano et al.

(10) Patent No.: US 6,933,935 B2
(45) Date of Patent: Aug. 23, 2005

(54) IMAGE DISPLAY APPARATUS AND METHOD OF DRIVING IMAGE DISPLAY APPARATUS

(75) Inventors: Osamu Sagano, Sagamihara (JP); Naoto Abe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 10/241,536

(22) Filed: Sep. 12, 2002

(65) Prior Publication Data

US 2003/0016195 A1 Jan. 23, 2003

Related U.S. Application Data

(62) Division of application No. 09/511,246, filed on Feb. 23, 2000, now Pat. No. 6,515,641.

(30) Foreign Application Priority Data

Feb. 25, 1999 (JP) ..... 11-049067
Feb. 15, 2000 (JP) ..... 2000-036861

(51) Int. Cl.[7] ..... G09G 3/36

(52) U.S. Cl. ..... 345/204; 345/76; 345/90; 345/98; 345/100; 345/207; 345/212; 345/690

(58) Field of Search ..... 345/76, 90, 98, 345/100, 204, 207, 212, 690

(56) References Cited

U.S. PATENT DOCUMENTS 4,206,460 A * 6/1980 Yasuda et al. ..... 345/76
4,646,079 A * 2/1987 Kitai et al. ..... 345/81

(Continued)

FOREIGN PATENT DOCUMENTS

| | | |
|---|---|---|
| JP | 64-31332 | 2/1989 |
| JP | 2-257551 | 10/1990 |
| JP | 3-55738 | 3/1991 |
| JP | 4-28137 | 1/1992 |
| JP | 6-47989 | 6/1994 |
| JP | 8-106264 | 4/1996 |
| JP | 8-278772 | 10/1996 |
| JP | 9-190160 | 7/1997 |
| JP | 9-269755 | 10/1997 |
| JP | 9-330063 | 12/1997 |
| JP | 10-117300 | 5/1998 |
| JP | 10-293558 | 11/1998 |
| JP | 10-319373 | 12/1998 |

OTHER PUBLICATIONS

M. Hartwell, et al., "Strong Electron Emission From Patterned Tin–Indium Oxide Thin Films", International Electron Devices Meeting, pp. 519–521 (1975).

(Continued)

*Primary Examiner*—Bipin Shalwala
*Assistant Examiner*—Vincent E. Kovalick
(74) *Attorney, Agent, or Firm*—Fitzpatrick, Cella, Harper & Scinto

(57) ABSTRACT

An image display apparatus includes row wiring, a plurality of column wirings, a modulator, and a plurality of display devices. The plurality of display devices are commonly connected to the row wiring, each of the plurality of column wirings is connected to a corresponding one of the plurality of display devices, and the modulator supplies a modulated signal to the column wirings. The modulator includes a pulse width modulator for generating a pulse signal having a time width corresponding to the tone of a signal to be displayed, and a potential setting circuit for setting the potential of the pulse signal in accordance with the type of signal to be displayed.

15 Claims, 13 Drawing Sheets

U.S. PATENT DOCUMENTS

| | | | | | |
|---|---|---|---|---|---|
| 4,802,018 | A | * | 1/1989 | Tanikawa et al. | 386/118 |
| 4,904,895 | A | | 2/1990 | Tsukamoto et al. | 313/336 |
| 5,066,883 | A | | 11/1991 | Yoshioka et al. | 313/309 |
| 5,117,298 | A | * | 5/1992 | Hirai | 345/96 |
| 5,311,169 | A | | 5/1994 | Inada et al. | 340/781 |
| 5,569,974 | A | | 10/1996 | Morikawa et al. | 313/310 |
| 5,682,085 | A | | 10/1997 | Suzuki et al. | 315/169.1 |
| 5,835,075 | A | * | 11/1998 | Nomura et al. | 345/97 |
| 5,956,011 | A | * | 9/1999 | Koyama et al. | 345/98 |
| 6,100,939 | A | | 8/2000 | Kougami et al. | 345/690 |
| 6,157,137 | A | * | 12/2000 | Suzuki et al. | 315/169.1 |
| 6,169,528 | B1 | | 1/2001 | Oguchi et al. | 345/74.1 |
| 6,236,385 | B1 | * | 5/2001 | Nomura et al. | 345/95 |
| 6,246,385 | B1 | | 6/2001 | Kinoshita et al. | 345/100 |
| 6,262,701 | B1 | | 7/2001 | Okuda et al. | 345/74.1 |
| 6,271,812 | B1 | | 8/2001 | Osada et al. | 315/169.1 |
| 6,278,474 | B1 | | 8/2001 | Wada et al. | 347/241 |
| 6,310,598 | B1 | * | 10/2001 | Koyama et al. | 345/98 |
| 6,426,588 | B1 | * | 7/2002 | Yanagisawa | 313/422 |
| 6,509,895 | B2 | * | 1/2003 | Yanagi et al. | 345/211 |
| 2002/0109455 | A1 | * | 8/2002 | Mitsutake et al. | 313/495 |
| 2002/0153243 | A1 | * | 10/2002 | Forrest et al. | 204/192.26 |

OTHER PUBLICATIONS

H. Araki, "Electroforming and Electron Emission of Carbon Thin Films", Journal of the Vacuum Society of Japan, vol. 26, No. 1, pp. 29–29 (1981).

G. Dittmer, "Electrical Conduction and Electron Emission of Discontinuous Thin Films", Thin Solid Films, vol. 9, pp. 317–328 (1972).

M.I. Elinson, et al., "The Emission of Hot Electrons and the Field Emission of Electrons From Tin Oxide", Radio Engineering and Electronic Physics, pp. 1290–1296 (1965).

C.A. Mead, "Operation of Tunnel–Emission Devices", Journal of Applied Physics, vol. 32, No. 4, pp. 646–652 (1961).

C.A. Spindt, et al., "Physical Properties of Thin–Film Field Emission Cathodes with Molybdenum Cones", Journal of Applied Physics, vol. 47, No. 12, pp. 5248–5263 (1976).

W.P. Dyke, et al., "Field Emission", Advances in Electronics and Electron Physics, vol. VIII, pp. 89–195 (1956).

R. Myer, "Recent Development on "Microtips" Display at LETI", Technical Digest of IVMC 91, pp. 6–9 (1991).

* cited by examiner

IMAGE DISPLAY APPARATUS AND METHOD OF DRIVING IMAGE DISPLAY APPARATUS

This is a divisional application of application Ser. No. 09/511,246, filed on Feb. 23, 2000 now U.S. Pat. No. 6,515,641.

FIELD OF THE INVENTION

The present invention relates to an image display apparatus and a method of driving the image display apparatus, particularly, to an image display apparatus constituted by commonly wiring a plurality of display devices and a driving method thereof, more particularly, to an image display apparatus having a display panel constituted by wiring a plurality of display devices in a matrix and a driving method thereof and, still more particularly, to an image display apparatus capable of displaying a television signal and computer video signal with high quality and a driving method thereof.

BACKGROUND OF THE INVENTION

Conventionally, two types of devices, namely thermionic and cold cathode devices, are known as electron-emitting devices. Known examples of the cold cathode devices are surface-conduction type emission devices, field emission type electron-emitting devices (to be referred to as FE type electron-emitting devices hereinafter), and metal/insulator/metal type electron-emitting devices (to be referred to as MIM type electron-emitting devices hereinafter).

A known example of the surface-conduction type emission devices is described in, e.g., M. I. Elinson, "Radio E-ng. Electron Phys., 10, 1290 (1965) and other examples will be described later.

The surface-conduction type emission device utilizes the phenomenon that electrons are emitted by a small-area thin film formed on a substrate by flowing a current parallel through the film surface. The surface-conduction type emission device includes electron-emitting devices using an Au thin film (G. Dittmer, "Thin Solid Films", 9,317 (1972)), an $In_2O_3/SnO_2$ thin film (M. Hartwell and C. G. Fonstad, "IEEE Trans. ED Conf.", 519 (1975)), a carbon thin film (Hisashi Araki et al., "Vacuum", Vol. 26, No. 1, p. 22 (1983)), and the like, in addition to an $SnO_2$ thin film according to Elinson mentioned above.

FIG. 11 is a plan view showing the device by M. Hartwell et al. described above as a typical example of the device structures of these surface-conduction type emission devices. Referring to FIG. 11, reference numeral 3001 denotes a substrate; and 3004, a conductive thin film made of a metal oxide formed by sputtering.

This conductive thin film 3004 has an H-shaped pattern, as shown in FIG. 11. An electron-emitting portion 3005 is formed by performing electrification processing (referred to as forming processing to be described later) with respect to the conductive thin film 3004. An interval L in FIG. 11 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction type emission devices by M. Hartwell et al. and the like, typically the electron-emitting portion 3005 is formed by performing electrification processing called forming processing for the conductive thin film 3004 before electron emission. In forming processing, a constant DC voltage or a DC voltage which increases at a very low rate of, e.g., 1 V/min is applied across the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

Known examples of the FE type electron-emitting devices are described in W. P. Dyke and W. W. Dolan, "Field Emission", Advance in Electron Physics, 8, 89 (1956) and C. A. Spindt, "Physical Properties of Thin-Film Field Emission Cathodes with Molybdenium Cones", J. Appl. Phys., 47, 5248 (1976).

FIG. 12 is a sectional view showing the device by C. A. Spindt et al. described above as a typical example of the FE type device structure. In FIG. 12, reference numeral 3010 denotes a substrate; 3011, an emitter wiring made of a conductive material; 3012, an emitter cone; 3013, an insulating layer; and 3014, a gate electrode. In this device, a voltage is applied between the emitter cone 3012 and gate electrode 3014 to emit electrons from the distal end portion of the emitter cone 3012.

As another FE type device structure, there is an example in which an emitter and gate electrode are arranged on a substrate to be almost parallel to the surface of the substrate, in addition to the multilayered structure of FIG. 12.

A known example of the MIM type electron-emitting devices is described in C. A. Mead, "Operation of Tunnel-Emission Devices", J. Appl. Phys., 32,646 (1961). FIG. 13 shows a typical example of the MIM type device structure. In FIG. 13, reference numeral 3020 denotes a substrate; 3021, a lower electrode made of a metal; 3022, a thin insulating layer having a thickness of about 100 Å; and 3023, an upper electrode made of a metal and having a thickness of about 80 to 300 Å. In the MIM type electron-emitting device, an appropriate voltage is applied between the upper and lower electrodes 3023 and 3021 to emit electrons from the surface of the upper electrode 3023.

Since the above-described cold cathode devices can emit electrons at a temperature lower than that for thermionic cathode devices, they do not require any heater. The cold cathode device has a structure simpler than that of the thermionic cathode device and can shrink in feature size. Even if a large number of devices are arranged on a substrate at a high density, problems such as heat fusion of the substrate hardly arise. In addition, the response speed of the cold cathode device is high, while the response speed of the thermionic cathode device is low because the thermionic cathode device operates upon heating by a heater.

For this reason, applications of the cold cathode devices have enthusiastically been studied.

Of cold cathode devices, the surface-conduction type emission devices have a simple structure and can be easily manufactured, and thus many devices can be formed on a wide area. As disclosed in Japanese Patent Laid-Open No. 64-31332 filed by the assignee of the present application, a method of arranging and driving a lot of devices has been studied.

Regarding applications of the surface-conduction type emission devices to, e.g., image forming apparatuses such as an image display apparatus and image recording apparatus, charge beam sources, and the like have been studied.

Particularly, as an application to image display apparatuses, as disclosed in the U.S. Pat. No. 5,066,883 and Japanese Patent Laid-Open Nos. 2-257551 and 4-28137 filed by the assignee of the present application, an image display apparatus using a combination of a surface-conduction type emission device and a fluorescent substance which emits light upon irradiation of an electron beam has been studied. This type of image display apparatus using a combination of the surface-conduction type emission device and fluorescent substance is expected to exhibit more excellent characteristics than other conventional image display apparatuses. For example, compared with recent popular liquid crystal display apparatuses, the above display apparatus is superior in that it does not require any backlight because it is of a self-emission type and that it has a wide view angle.

A method of driving a plurality of FE type electron-emitting devices arranged side by side is disclosed in, e.g., U.S. Pat. No. 4,904,895 filed by the assignee of the present application. As a known example of an application of FE type electron-emitting devices to an image display apparatus is a flat panel display reported by R. Meyer et al. (R. Meyer:"Recent Development on Microtips Display at LETI", Tech. Digest of 4th Int. Vacuum Microelectronics Conf., Nagahama, pp. 6–9 (1991)).

An application of a larger number of MIM type electron-emitting devices arranged side by side to an image display apparatus is disclosed in Japanese Patent Laid-Open No. 3-55738 filed by the assignee of the present application.

SUMMARY OF THE INVENTION

It is an object of the present invention to realize an image display apparatus capable of displaying various kinds of signals with high quality in an arrangement in which a plurality of display devices are commonly wired, and a driving method thereof.

One aspect of an image display apparatus according to the present invention comprises the following arrangement.

An image display apparatus comprises a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, wherein the modulator includes a pulse width modulator for generating a pulse signal having a time width corresponding to a tone of a signal to be displayed, and a potential setting circuit for setting a potential of the pulse signal in accordance with a type of signal to be displayed.

The pulse width modulator and potential setting circuit, or the modulator including them may be one integrated circuit. The modulator and another circuit may be integrated into one.

The potential of a pulse signal having a modulated time width may be adjusted by the potential setting circuit. Alternatively, a pulse width signal having a modulated time width may be generated at a potential set in advance by the potential setting circuit. This aspect incorporates both the arrangements. Note that the potential to be applied to the column wiring is set while a predetermined signal is supplied to the row wiring and the plurality of display devices can be driven. In particular, when a high-level period is to be changed in pulse width modulation, a high-level potential is set. In this case, the "high level" of the signal means a level corresponding to a signal which drives the device or a signal for a high driving state, with respect to a low level corresponding to a signal which does not drive the device or a signal for a low driving state. Low- and high-level signals do not always have lower and higher potentials, respectively.

According to this aspect, the tone is controlled by the pulse width of a pulse signal, and control corresponding to the type of signal to be displayed is executed by controlling the potential of a pulse signal. The influence on tone control caused by control corresponding to the type of signal to be displayed can be preferably suppressed.

In this aspect, a longitudinal direction of the column wiring preferably crosses a longitudinal direction of the row wiring.

In each aspect, it is preferable that the row wiring include a plurality of row wirings, a plurality of display devices be connected to each row wiring, and each of the plurality of display devices connected to the row wiring share a corresponding column wiring with each of a plurality of display devices connected to another row wiring.

This includes so-called matrix wiring. The matrix wiring has a plurality of row wirings, a plurality of column wirings extending to cross the row wirings, and display devices arranged in correspondence with the intersections of the row and column wirings. Each display device may be arranged at or near the intersection. The display device is connected at a corresponding intersection to row and column wirings crossing each other.

The image display apparatus preferably further comprises a scanning circuit for supplying a scan signal for sequentially scanning the plurality of row wirings. As the scanning circuit, this aspect can preferably employ a circuit for applying a selection potential to a selected row wiring. This aspect can preferably adopt an arrangement in which the display device is driven by a voltage applied to it owing to the difference between the selection potential and the potential of a pulse signal supplied to the column wiring. A predetermined non-selection potential is preferably applied to an unselected row wiring.

The above aspect can be preferably applied when the display device consumes only part of a current flowing into the display device for display.

In this arrangement, a current (particularly, a current not consumed by the display device for display) flows through the row wiring to increase the influence of the voltage drop on the row wiring which applies the potential to one end of each of a plurality of simultaneously drivable devices. This arrangement can preferably adopt the aspect of the present invention in which the pulse width can be adjusted in accordance with the type of signal. The present invention is effective in an arrangement in which a row wiring commonly connected to a plurality of simultaneously drivable display devices flows even a small current which is not consumed by the display device for display. The present invention is especially effective when 20% or more of a current flows into the display device, and more preferably 50% or more of the current flows through the column or row wiring without consuming the current for display. For example, most of surface-conduction type emission devices (to be described later in the following embodiments) consume about less than several % of a flowing current for emission. Most of EL devices known as display devices consume about several ten % of a flowing current for emission. In either case, the present invention can be preferably applied. Note that the current consumed by the display device for display includes a current consumed as heat in display operation.

Each aspect can preferably employ an arrangement in which the apparatus further comprises a plurality of input portions for inputting an image signal to be displayed, and a selector for selecting any one of signals from the plurality of input portions, and the potential setting circuit sets the potential of the pulse signal in accordance with a selection state of the selector, an arrangement in which the apparatus further comprises a discrimination circuit for discriminating a characteristic of an image signal to be displayed, and the potential of the pulse signal is set in accordance with a discrimination result of the discrimination circuit, or an arrangement in which the apparatus further comprises external setting means for setting the potential of the pulse signal in accordance with an image to be displayed, and the potential setting circuit sets the potential of the pulse signal in accordance with a setting of the external setting means.

In each aspect, the potential setting circuit desirably sets the potential in accordance with whether importance is attached to luminance or reproducibility in displaying an input image signal. When luminance is more important than reproducibility in displaying an input image signal, the potential set by the potential setting circuit is desirably set to have a larger potential difference from a potential applied to the row wiring than when reproducibility is more important than luminance.

In each aspect, the potential setting circuit preferably sets the potential of the pulse signal in accordance with whether the signal to be displayed is a computer image signal or a television image signal. More specifically, when the computer image signal is to be displayed, the potential of a pulse signal is set to have a smaller potential difference from a potential applied to the row wiring than when the television image signal is to be displayed.

Another aspect of an image display apparatus according to the present invention comprises the following arrangement.

An image display apparatus comprises a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, wherein the modulator includes a potential setting circuit for setting a potential of a signal supplied to the row wiring in accordance with a type of signal to be displayed.

This arrangement can preferably realize control corresponding to the type of image signal displayed by a signal supplied to the row wiring, independently of modulation control using a signal supplied to the column wiring. In this aspect, the modulator can adopt an arrangement of generating a pulse width-modulated signal having a time width corresponding to the tone of a signal to be displayed, and an arrangement of generating a peak value-modulated signal having a peak value corresponding to the tone of a signal to be displayed. The pulse width modulating arrangement is more desirable in terms of tone display.

Also in this aspect, a longitudinal direction of the column wiring preferably crosses a longitudinal direction of the row wiring. This aspect can preferably be applied to an arrangement in which the row wiring includes a plurality of row wirings, a plurality of display devices are connected to each row wiring, and each of the plurality of display devices connected to the row wiring shares a corresponding column wiring with each of a plurality of display devices connected to another row wiring.

The image display apparatus desirably further comprises a scanning circuit for supplying a scan signal for sequentially scanning the plurality of row wirings. More specifically, the scanning circuit can preferably adopt an arrangement of applying a selection potential to a selected row wiring. In this arrangement, the selection potential is set in accordance with the type of image signal to be displayed.

Still another aspect of an image display apparatus according to the present invention comprises the following arrangement.

An image display apparatus comprises a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, wherein the modulator includes a peak value modulator for generating a signal having a peak value corresponding to a tone of a signal to be displayed, and a peak value setting circuit for setting an upper limit of the peak value in accordance with a type of signal to be displayed.

In this aspect, the upper limit of the peak value is relative. When modulation is done such that the potential of a signal corresponding to a high tone is set high, and the potential of a signal corresponding to a low tone is set low in controlling the peak value of a signal by controlling the potential of the signal, the upper value of the peak value is the upper limit of the potential. When modulation is done such that the potential of a signal corresponding to a high tone is set low, and the potential of a signal corresponding to a low tone is set high, the upper limit of the peak value is the lower limit of the potential. In this aspect, the minimum value of the amplitude of the peak value may also be set.

The above aspects of the present invention are preferable when the display device consumes 80% or less of a current flowing into the display device for display, and more preferable when the display device consumes 50% or less of a current flowing into the display device for display.

In the above-described aspects, the display device is, e.g., an electron-emitting device. This electron-emitting device is desirably used in combination with an emission substance (especially, a fluorescent substance) for emitting light upon irradiation of electrons emitted by the electron-emitting device. As the electron-emitting device, a cold cathode device can be preferably employed. The present invention is more preferable in an arrangement using a surface-conduction type emission device. When the display device is an electron-emitting device, an image can be displayed with high quality using a fluorescent substance for emitting light upon irradiation of electrons emitted by the electron-emitting device.

Even when the display device is an electroluminescent device, the above aspects can be preferably used. When the display device is an electroluminescent device, since the device itself emits light, it is preferable.

One aspect of a method of driving an image display apparatus according to the present invention is as follows.

A method of driving an image display apparatus having a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, comprises the step of applying to the column wiring a pulse width-modulated signal having a potential set in accordance with a type of signal to be displayed and a time width corresponding to a tone of the signal to be displayed, thereby modulating the display device.

Another aspect of a method of driving an image display apparatus according to the present invention is as follows.

A method of driving an image display apparatus having a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, comprises the step of setting a potential of a signal supplied to the row wiring in accordance with a type of signal to be displayed.

Still another aspect of a method of driving an image display apparatus according to the present invention is as follows.

A method of driving an image display apparatus having a row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, comprises the steps of generating a signal having a peak value corresponding to a tone of a signal to be displayed, and setting an upper limit of the peak value in correspondence with a type of signal to be displayed.

Note that the above-mentioned aspects are more preferable when the modulator outputs a potential-controlled signal (e.g., high-level potential) as a control target than when the modulator outputs a current-controlled signal as a control target.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

DESCRIPTION OF THE PREFERRED EMBODIMENTS

The present inventors have examined electron-emitting devices of various materials, various manufacturing methods, and various structures, in addition to the above-mentioned conventional electron-emitting device. Further, the present inventors have made extensive studies on a multi electron source having a large number of electron-emitting devices, and an image display apparatus using this multi electron source.

Figure 9:
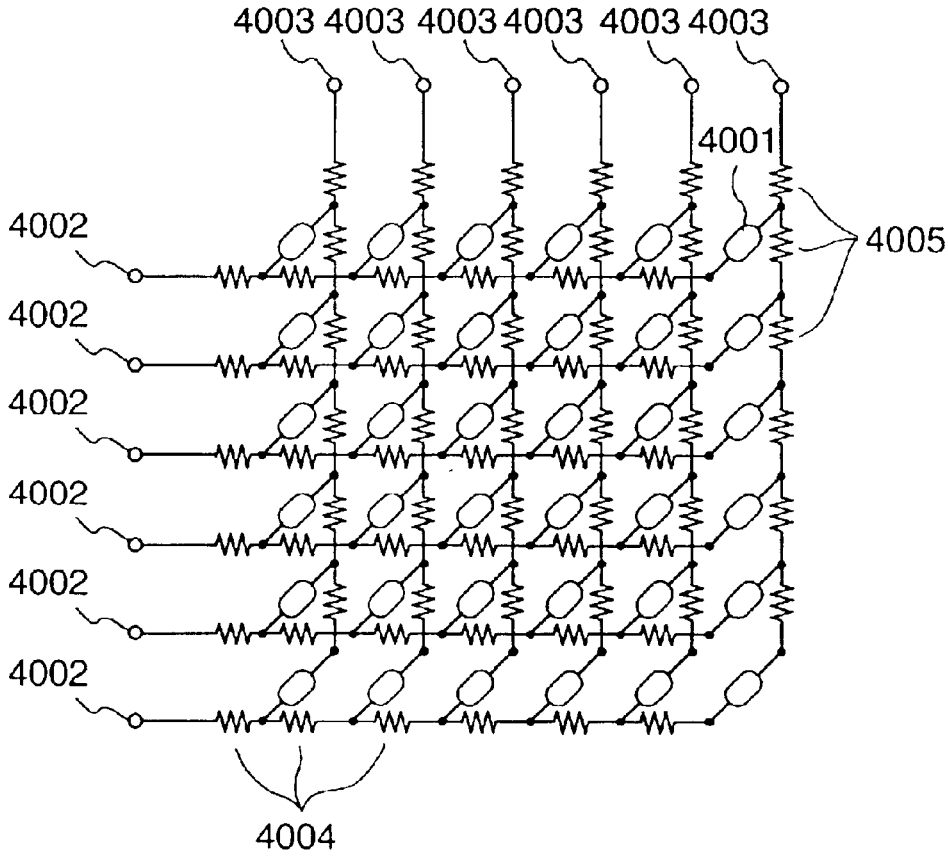
FIG. 9 is a diagram for explaining the electrical wiring of the display panel according to the present invention.

The present inventors have examined a multi electron source having an electrical wiring method shown in, e.g., FIG. 9. That is, a large number of electron-emitting devices are two-dimensionally arranged in a matrix to obtain a multi electron source, as shown in FIG. 9.

Referring to FIG. 9, numeral 4001 denotes an electron-emitting device; numeral 4002 denotes row wirings; and numeral 4003 denotes column wirings. Each of the row and column wirings 4002 and 4003 actually has finite electrical resistances, which are represented as wiring resistances 4004 and 4005, respectively, in FIG. 9. This wiring method is called a simple matrix wiring method.

For the illustrative convenience, the multi electron source is illustrated in a 6×6 matrix, but the size of the matrix is not limited to this. For example, in a multi electron source for an image display apparatus, a number of devices enough to perform a desired image display are arranged and wired.

In a multi electron source in which electron-emitting devices are arranged in a simple matrix, appropriate electrical signals are applied to the row and column wirings 4002 and 4003 to output a desired electron beam. For example, to drive the electron-emitting devices on an arbitrary row in the matrix, a selection potential Vs is applied to the row wiring 4002 on the row to be selected, and at the same time, a non-selection potential Vns is applied to the row wirings 4002 on unselected rows. In synchronism with this, a driving potential Ve for outputting an electron beam is applied to the column wirings 4003. According to this method, when voltage drops across the wiring resistances 4004 and 4005 are neglected, a voltage (Ve−Vs) is applied to the electron-emitting device on the selected row, and a voltage (Ve−Vns) is applied to the electron-emitting devices on the unselected rows. When the voltages Ve, Vs, and Vns are set to appropriate levels, an electron beam having a desired intensity is output from only the electron-emitting device on the selected row. When different driving potentials Ve are applied to the respective column wirings, electron beams having different intensities are output from respective devices on the selected row. Since the cold cathode device has a high response speed, a time for outputting an electron beam can be changed by changing a time for applying the driving potential Ve.

A multi electron source obtained by arranging electron-emitting devices in a simple matrix has a variety of applications. For example, when a potential signal corresponding to image information is appropriately applied, the multi electron source can be applied as an electron source for an image display apparatus.

However, when the multi electron source is actually connected to a voltage source and driven by this voltage application method, the voltage effectively applied to respective electron-emitting devices varies owing to a voltage drop caused by the wiring resistance.

As the first cause of varying the voltage applied to respective devices, the electron-emitting devices have different wiring lengths (different wiring resistances) in the simple matrix wiring.

Second, the magnitudes of voltage drops caused by the wiring resistances 4004 at the respective portions of the row wiring are nonuniform. This is because a current branches and flows from the row wiring of a selected row to respective electron-emitting devices connected to the row, and thus currents flowing through the respective wiring resistances 4004 become nonuniform.

Third, the magnitude of a voltage drop caused by the wiring resistance changes depending on a driving pattern (displayed image in the image display apparatus). This is because a current flowing through the wiring resistance changes depending on the driving pattern.

Due to these causes, if the voltage applied to respective electron-emitting devices varies, the intensity of an electron beam output from each electron-emitting device shifts from a desired value disadvantageously. For example, when electron-emitting devices are applied to an image display apparatus, the luminance of a display image becomes nonuniform or varies depending on the display image pattern.

The influence of a luminance decrease caused by the voltage drop is less conspicuous to a subjectively negligible degree on a natural image such as a general television broadcast, but often provides an unnatural image particularly in displaying a flat image represented by a computer output.

Figure 10:
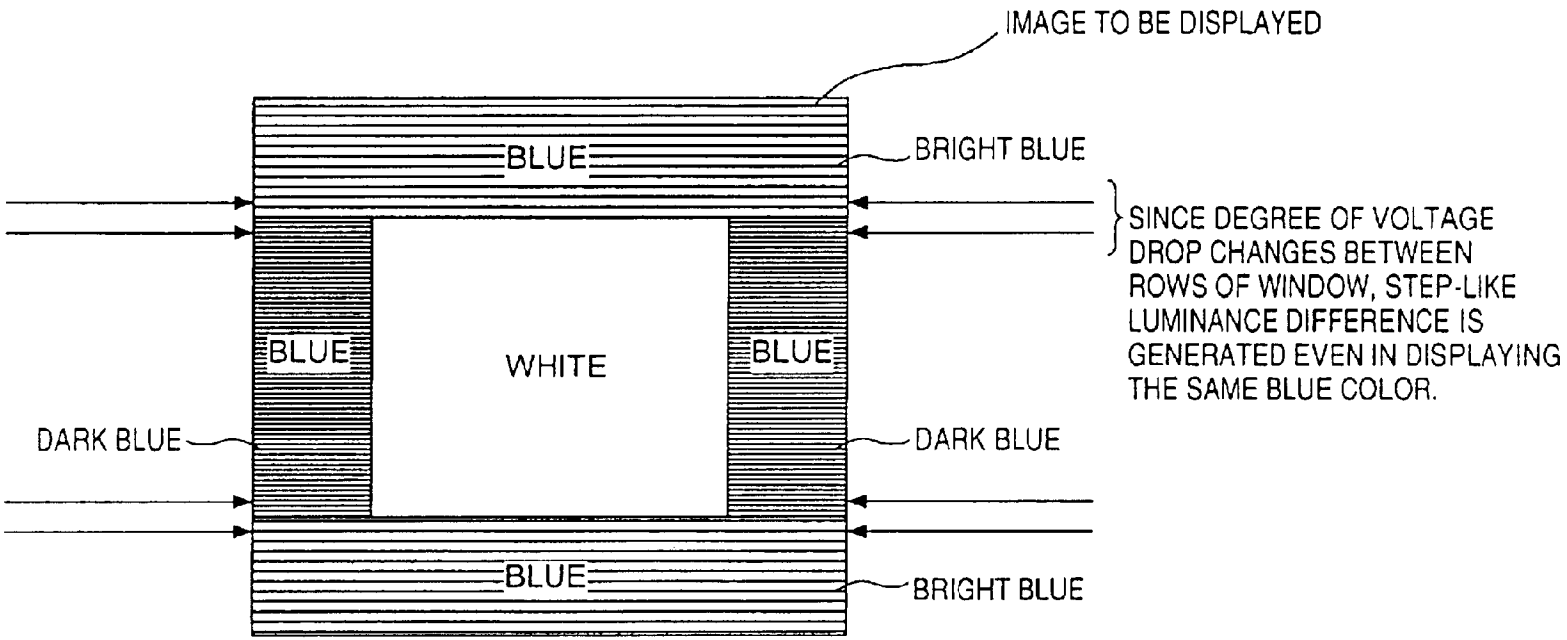
FIG. 10 is a view for explaining the problem of the present invention.
Figure 11:
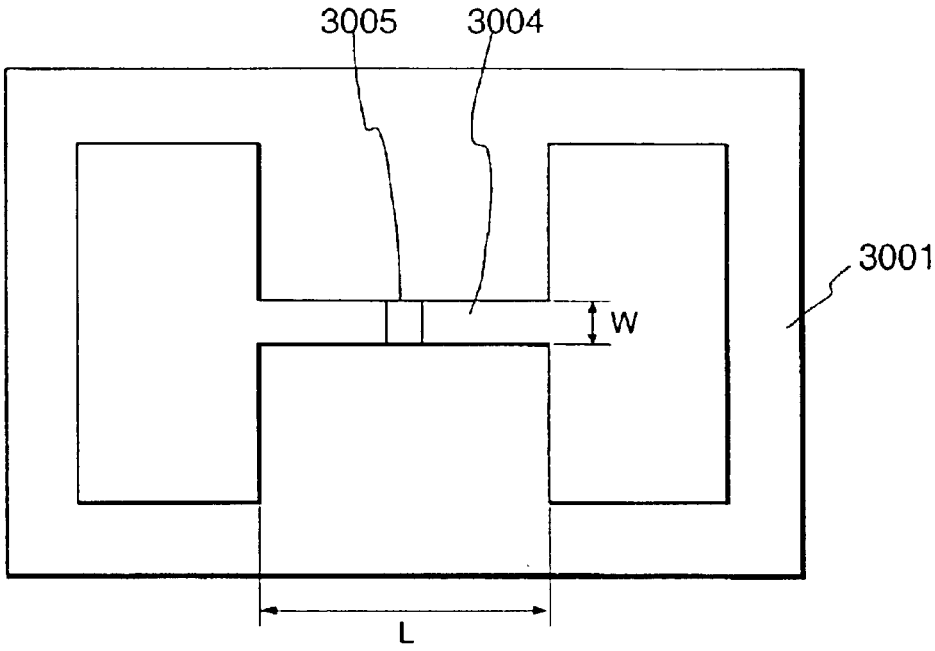
FIG. 11 is a plan view showing a conventionally known surface-conduction type emission device.
Figure 12:
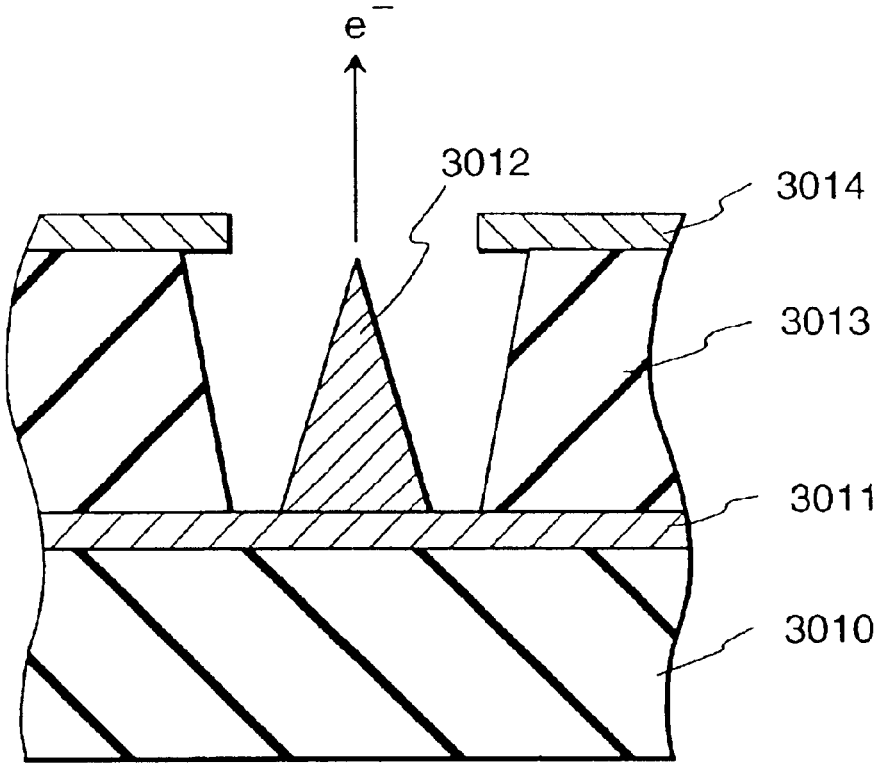
FIG. 12 is a side view showing a conventionally known FE type device.
Figure 13:
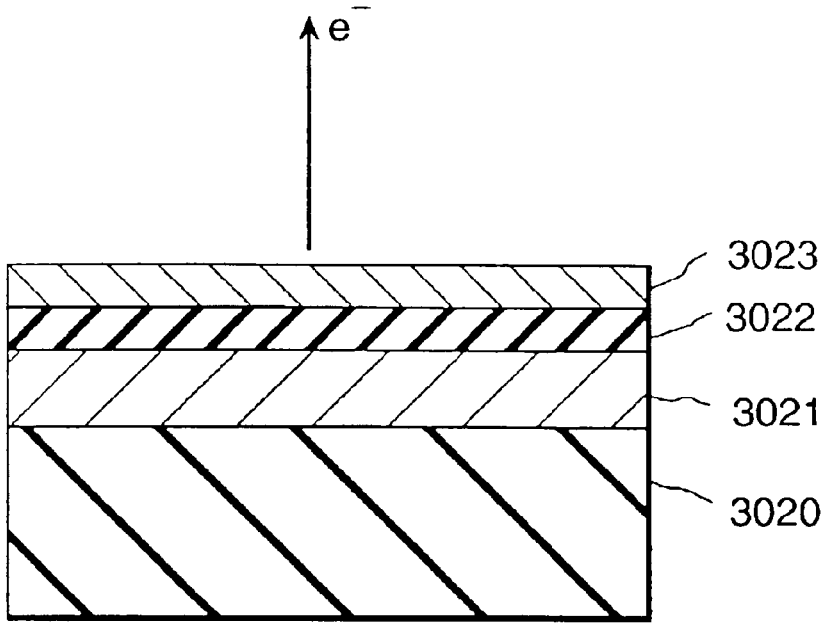
FIG. 13 is a sectional view showing a conventionally known MIM type device.

FIG. 10 is a view for explaining this problem of the present invention. FIG. 10 shows an original image of a window screen that is a typical computer output image as an image to be displayed.

The screen in FIG. 10 displays a window with a background of only blue (for RGB tonality, R:0%, G:0%, B:100%) and a center of only white (for RGB tonality, R:100%, G:100%, B:100%). When this original image is displayed, a row including both the background and window and a row including only the background are compared to find that the blue luminance is different between them because of different voltage drop amounts caused by a display pattern difference regardless of the same blue color of the original image. Upon displaying an image of such pattern, the difference in luminance disadvantageously appears like steps at the boundary between horizontal lines of the window.

Especially, a luminance decrease caused by the influence of the wiring resistance becomes more noticeable nearer the center of the screen, and the image changes with gradation as a whole. However, the human visual characteristic is very insensitive to this continuous change, and the image looks natural.

To the contrary, when a step-like luminance difference is generated between adjacent rows, the human visual characteristic is very sensitive to even a slight change. Upon displaying a computer image, a luminance difference is undesirably generated along the horizontal line of the window.

In general, a computer output image is displayed with a lower luminance than that of a general TV image owing to the application purpose.

The following embodiments will exemplify an image display apparatus which can reduce an unnatural pattern generated upon displaying a computer image while considering the characteristics of the computer image, and can generally display an image having a wide dynamic range in displaying a natural image represented by an HDTV signal or another TV signal.

First Embodiment

The first embodiment concerns an example of modulation using a voltage pulse width-modulated signal as a modulated signal in order to obtain a desired image in a display apparatus having many surface-conduction type emission devices.

Figure 4:
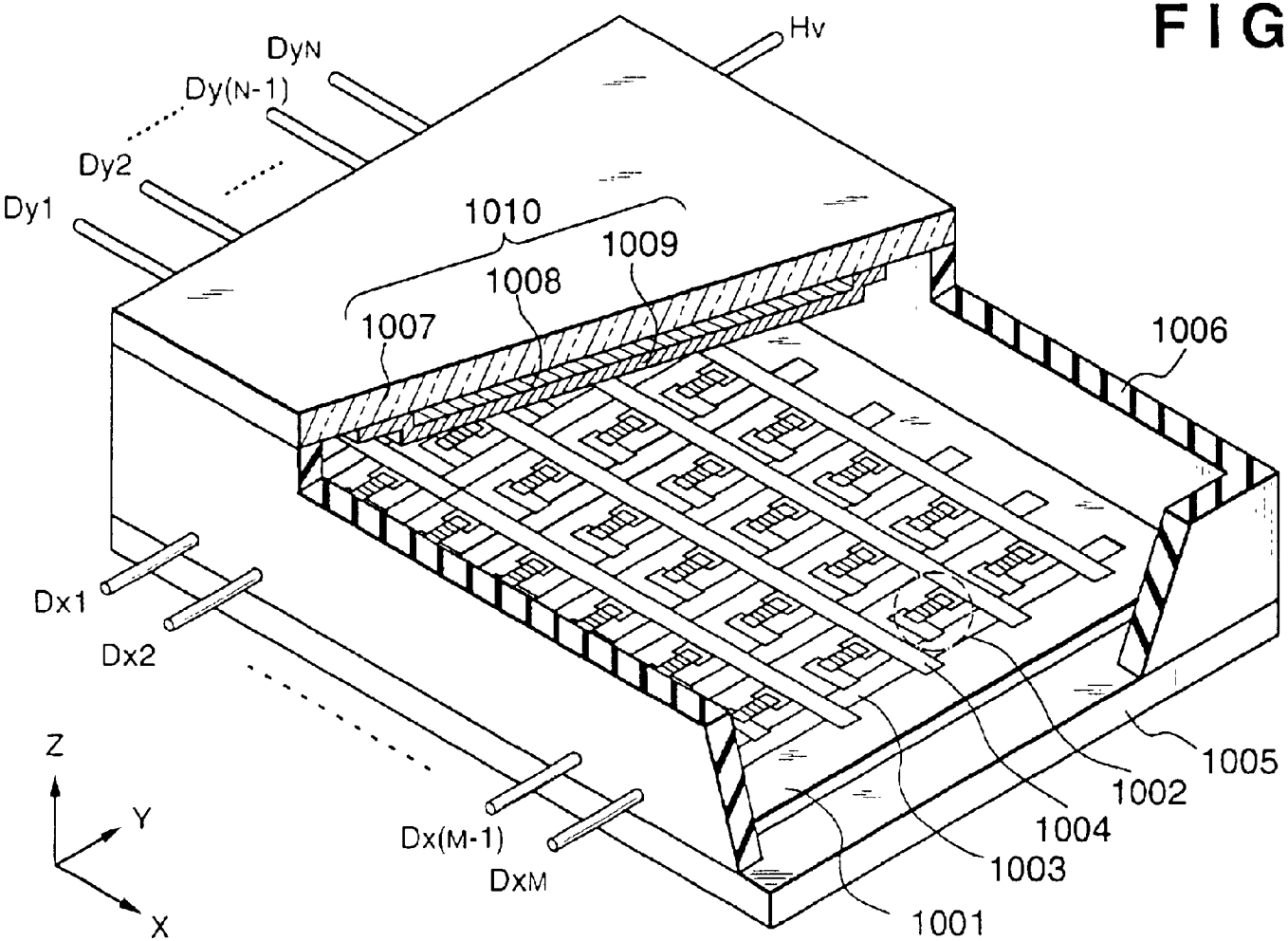
FIG. 4 is a partially cutaway perspective view showing the display panel of the image display apparatus according to the embodiment of the present invention.

FIG. 4 is a partially cutaway perspective view of the display panel used in the first embodiment showing the internal structure of the panel. In FIG. 4, reference numeral 1005 denotes a rear plate; 1006, a side wall; and 1007, a face plate. These parts 1005 to 1007 constitute an airtight container for maintaining the inside of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed thereon, on which N×M cold cathode devices 1002 are formed. The N×M cold cathode devices are arranged in a simple matrix with M row wirings 1003 and N column wirings 1004. The portion constituted by the components denoted by references 1001 to 1004 will be referred to as a multi electron source.

A fluorescent film 1008 is formed on the lower surface of the face plate 1007. As the first embodiment is a color display apparatus, the fluorescent film 1008 is coated with red, green, and blue fluorescent substances, i.e., three primary color fluorescent substances used in the CRT field.

In the first embodiment, surface-conduction type emission devices are formed as cold cathode devices in the display panel having the above outer appearance.

Figure 3:
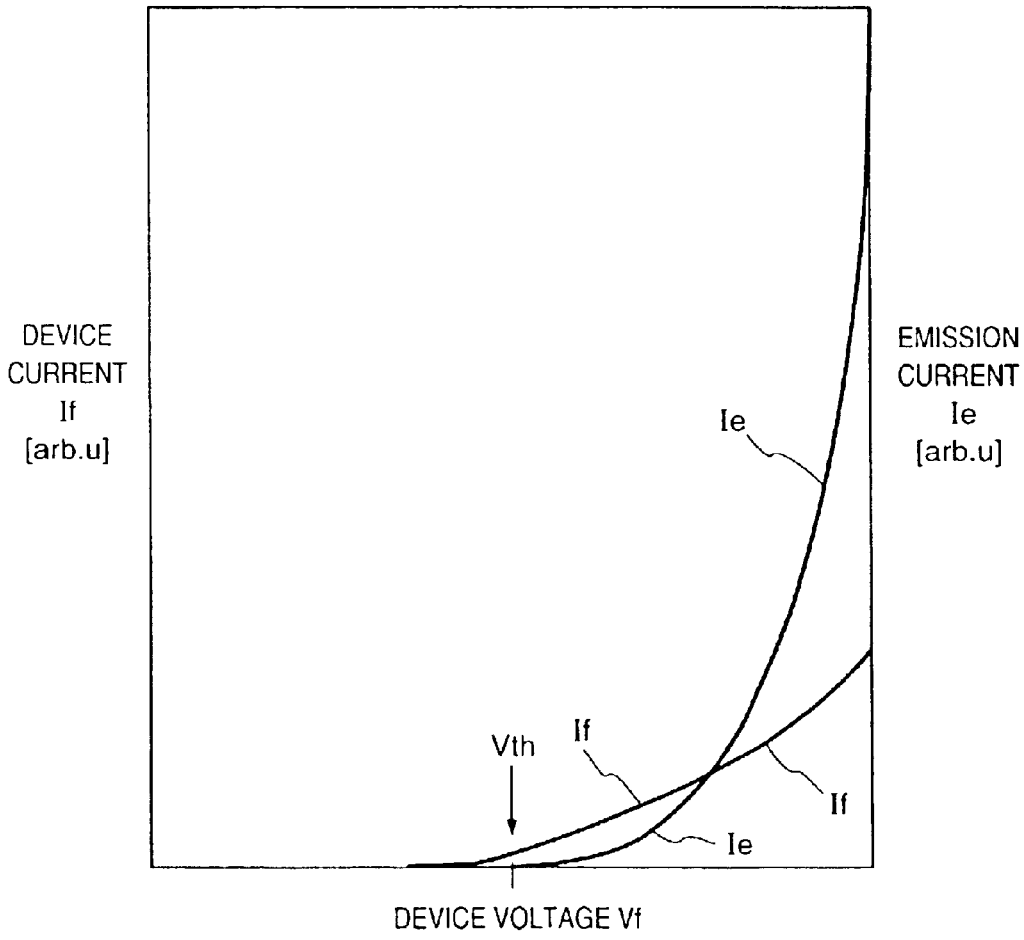
FIG. 3 is a graph showing the typical characteristic of a surface-conduction type emission device used in the embodiment of the present invention.

The surface-conduction type emission device has an (emission current Ie) vs. (device application voltage Vf) characteristic and (device current If) vs. (device application voltage Vf) characteristic as shown in FIG. 3. Note that compared with the device current If, the emission current Ie is very small, therefore it is difficult to illustrate the emission current Ie by the same measure of that for the device current If. For this reason, the graph illustrates two curves in different measures.

Regarding the emission current Ie, the device has three characteristics:

First, when a voltage of a predetermined level (referred to as "threshold voltage Vth") or more is applied to the device, the emission current Ie drastically increases, however, with a voltage lower than the threshold voltage Vth, almost no emission current Ie is detected. In FIG. 3, Vth is 8 V.

That is, regarding the emission current Ie, the device has a nonlinear characteristic based on the clear threshold voltage Vth. Second, the emission current Ie changes in dependence upon the device application voltage Vf. Accordingly, the emission current Ie can be controlled by changing the voltage Vf.

Third, the emission current Ie quickly flows by application of the voltage Vf to the device. Accordingly, an amount of electrons to be emitted by the device can be controlled by changing period of application of the voltage Vf.

The surface-conduction type emission device with these characteristics can be preferably applied to the display apparatus. For example, in a display apparatus having a large number of devices provided corresponding to the number of pixels of a display screen, if the first characteristic is utilized, display by sequential scanning of the display screen is possible. This means that the threshold voltage Vth or greater is appropriately applied to a driven device in accordance with a desired emission luminance, while a voltage lower than the threshold voltage Vth is applied to an unselected device. Devices to be driven are sequentially changed to sequentially scan the display screen, thereby performing display.

Further, the emission luminance can be controlled utilizing the second or third characteristic, which enables tone display.

The first embodiment displays an image using the first and third characteristics of the surface-conduction type emission device.

Figure 1:
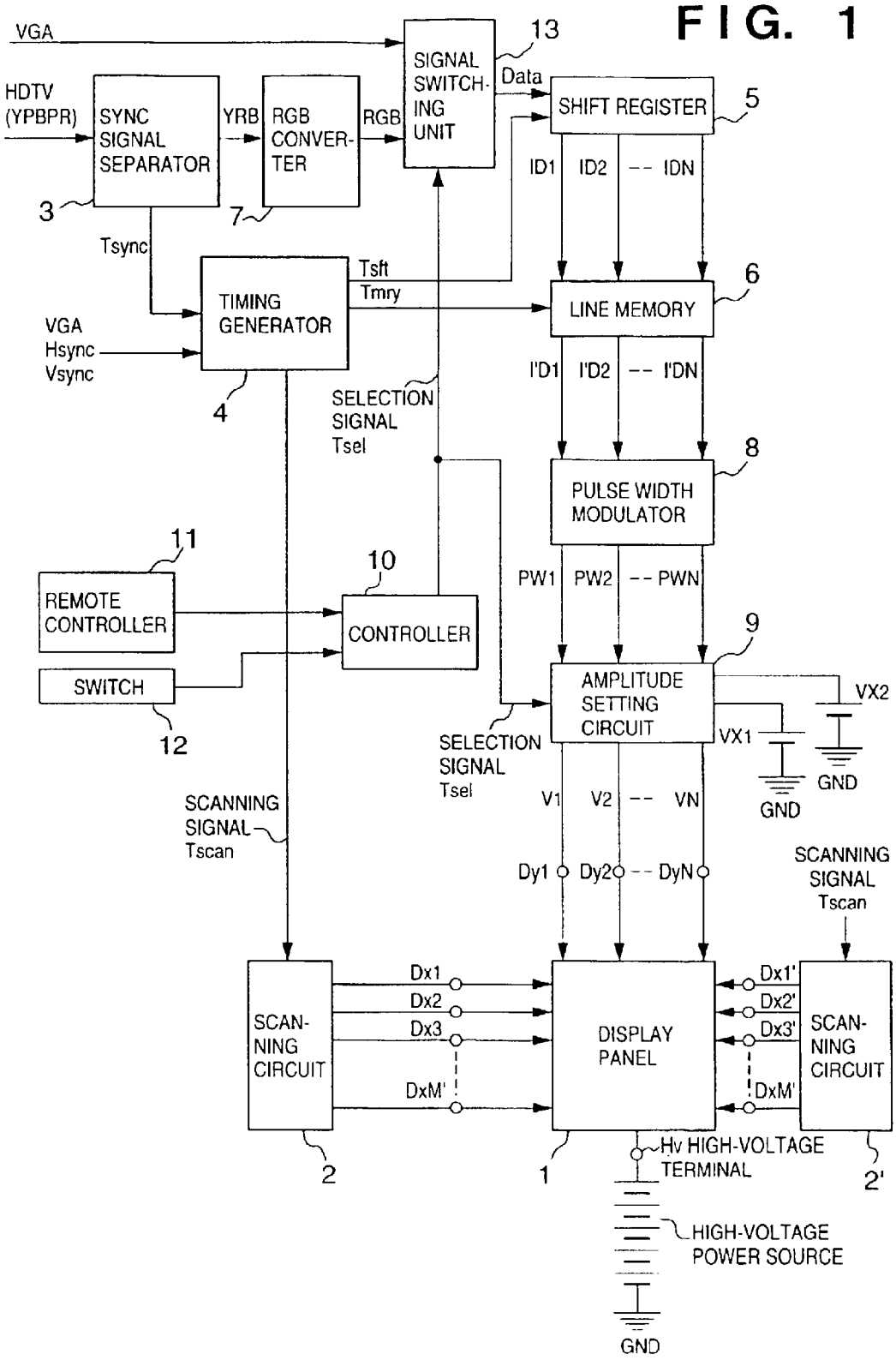
FIG. 1 is a block diagram for explaining an image display apparatus according to the first embodiment of the present invention.

FIG. 1 is a block diagram schematically showing a circuit arrangement. In FIG. 1, reference numeral 1 denotes a display panel incorporating a multi electron source. Reference symbols Dx1 to DxM' denote row wiring terminals of the multi electron source; Dy1 to DyN, column wiring terminals of the multi electron source; Hv, a high-voltage terminal for applying an accelerating voltage between face and rear plates; and Va, a high-voltage power source. Reference numerals 2 and 2' denote scanning circuits; 3, a sync signal separator; 4, a timing generator; 7, a converter for converting a YRB signal from the sync separator into an RGB signal; 13, a signal switching unit for switching between an HDTV RGB signal (signal based on the High Definition Television System standard) and a VGA signal (signal based on the VGA (Video Graphic Array) standard); 5, a shift register for one line of image data; 6, a line memory for one line of image data; 8, a pulse width modulator; 9, an amplitude setting circuit; 10, a controller; 11, a remote controller interface; and 12, a switch for controlling the image display apparatus. Note that the first embodiment uses a surface-conduction type emission device as the electron-emitting device of the multi electron source.

Sync Separator and Timing Generator

The image display apparatus of the first embodiment can display both an HDTV television signal and a VGA signal which is an output from a computer or the like. Note that this embodiment is merely an example, and the image display apparatus can be similarly applied to another standard such as NTSC, PAL, and SECAM.

A VGA signal is supplied to the signal switching unit 13, whereas sync signals Vsync and Hsync are supplied to the timing generator 4. An HDTV television signal is separated into a sync signal Tsync (including vertical and horizontal sync signals) and video signal YRB by the sync separator 3. The signal Tsync is supplied to the timing generator 4. The video signal YRB is converted by the RGB converter 7 into a digital RGB signal, which is supplied to the signal switching unit 13. The signal switching unit 13 selects between VGA and HDTV, and switches a video source in accordance with a selection signal Tsel from the controller 10. The controller 10 supplies the selection signal Tsel to each unit after a video source to be selected is set through the remote controller 11 or switch 12.

The timing generator 4 determines the operation timing of each unit in synchronism with a video source sync signal on the selected side based on the selection signal Tsel. That is, the timing generator 4 generates signals such as a signal Tsft for controlling the operation timing of the shift register 5, a signal Tmry for controlling the operation timing of the line memory 6, and a signal Tscan for controlling the operation of the scanning circuit 2.

Scanning Circuit

Figure 2:
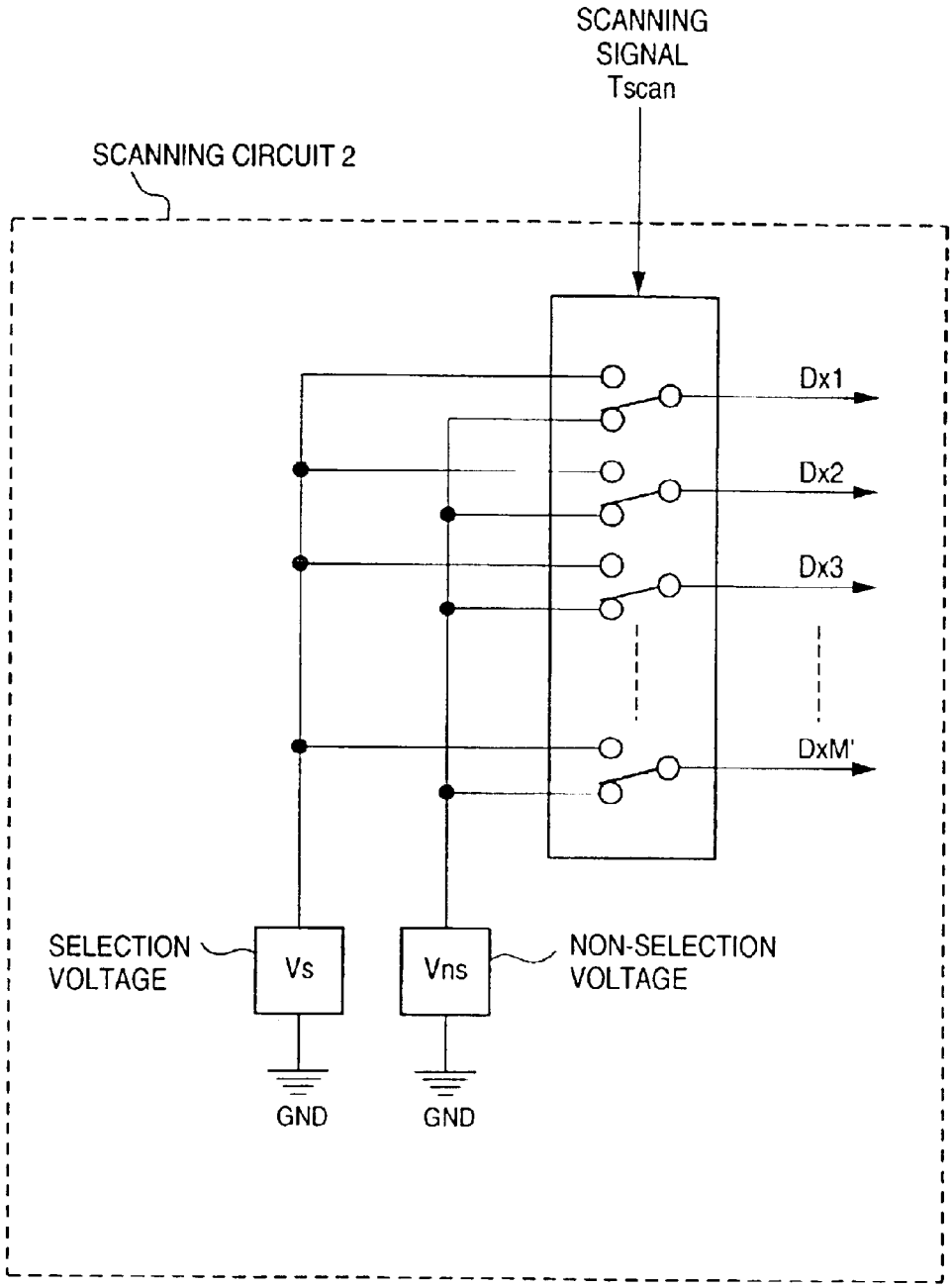
FIG. 2 is a circuit diagram for explaining scanning circuits 2 and 2' in the image display apparatus of the present invention.

The scanning circuits 2 and 2' output a selection potential Vs or non-selection potential Vns to the connected terminals Dx1 to DxM' in order to sequentially scan the multi electron source in units of rows. Each scanning circuit incorporates, e.g., M' switches, as shown in FIG. 2. Each switch is preferably made up of a transistor and FET.

The values of the selection potential Vs and non-selection potential Vns output from the scanning circuits 2 and 2', and the value of a modulated signal (to be described later) are determined based on the (emission current Ie) vs. (device application voltage Vf) characteristic and (device current If) vs. (device application voltage Vf) of a cold cathode device in use.

The surface-conduction type emission device of the first embodiment requires a voltage of about +12 to +15 V as the device application voltage Vf in order to display a desired image.

In the first embodiment, therefore, the selection potential and non-selection potential are respectively set to −7.5 V and 0 V. A potential of +5 V to +7.5 V is applied during a time corresponding to image data to be displayed from the modulation side. Then, electrons are emitted to obtain a desired image.

Shift Register, Line Memory, and Pulse Width Modulator

Image data separated by the sync signal separator 3 is serial/parallel-converted by the shift register 5, and stored in the line memory 6 during one horizontal scanning period. The pulse width modulator 8 outputs pulse width-modulated voltage signals PW1 to PWN on the basis of image data I'D1 to I'DN stored in the line memory 6.

Arrangement of Amplitude Setting Circuit

Figure 5:
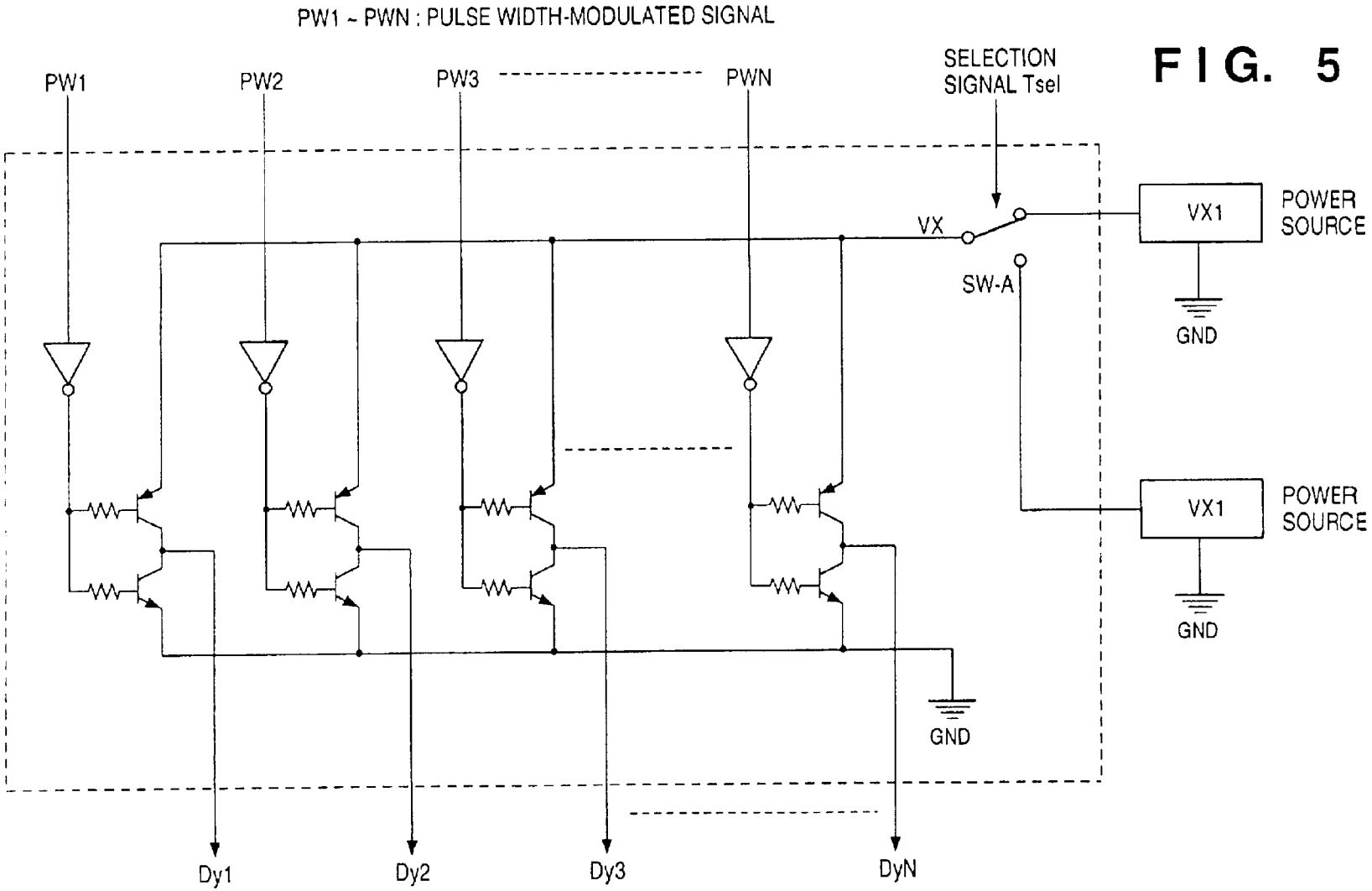
FIG. 5 is a circuit diagram for explaining an arrangement of an amplitude setting circuit (means) 9 according to the first embodiment of the present invention.

The amplitude setting circuit 9 as a potential setting circuit changes the amplitudes of pulse width-modulated signals PW1 to PWN in accordance with a selected video source (see FIG. 5). While the pulse width-modulated signal PWi (i=1, 2, . . . , N) is HIGH, pnp and npn transistors in FIG. 5 are respectively turned on and off to supply a potential VX to the column wiring terminals Dy1 to DyN. While the signal PWi is LOW, the pnp and npn transistors are respectively turned off and on to ground the column wiring terminals Dy1 to DyN.

The potential VX is set in accordance with the selection signal Tsel. When the video signal is a natural image signal such as an HD signal, the potential VX is connected to a power source VX1 through a switch SW-A; and when the video signal is a computer output such as a VGA signal, the potential VX is connected to a power source VX2. In the first embodiment, the potentials of VX1 and VX2 are respectively set to +7.5 V and +6 V. As described in the part preceding the description of the first embodiment, a computer output image is generally displayed at a low luminance as a whole because the user directly watches the monitor. To suppress the luminance of the entire screen, for example, an accelerating potential Va for accelerating electrons emitted by the electron-emitting device is decreased, image data (corresponding to a pulse width after pulse width modulation in the first embodiment) is reduced, or the application voltage is reduced.

The present inventors have examined these methods to find that it is optimal to reduce the driving voltage (driving voltage for driving the device) applied to the display panel.

This is because a lower driving voltage Vf applied between the row and column wirings of the display panel reduces a current flowing through the row and column wirings. A smaller current flowing through the wiring can reduce the voltage drop on the wiring. This can advantageously reduce the above-described image unnaturalness.

(If the pulse width (application time) is shortened without reducing the driving voltage, the voltage drop caused by the wiring resistance cannot be reduced, so the above-described image unnaturalness cannot be reduced.)

In displaying a natural image represented by an HDTV signal or another television signal, driving is done at a higher driving voltage than in the computer display mode. Accordingly, an image can be preferably displayed with reality at high luminance.

Characteristics of Display Panel

The display panel of the first embodiment has a so-called simple matrix structure in which cold cathode devices are arranged at the intersections of M row wirings and N column wirings. Displaying a high-quality image requires desired numbers of row and column wirings. The first embodiment has examined an image display apparatus having 480 row wirings and 2,556 (852×3) column wirings. The image display apparatus of this embodiment may suffer a voltage drop mainly caused by the wiring resistance of the row wiring, and thus the wiring resistance of the row wiring is preferably set as low as possible. In terms of the material and process conditions of the wiring, the display panel examined in this embodiment has Resistance per Row Wiring=0.5 Ω

The surface-conduction type emission device as the cold cathode device in the first embodiment was manufactured with characteristics as shown in Table 1:

TABLE 1

| Application Voltage | Device Current | Emission Current |
|---|---|---|
| +15 V | 0.5 (mA) | 4 (μA) |
| +13.5 V | 0.22 (mA) | 1.5 (μA) |

Figure 6:
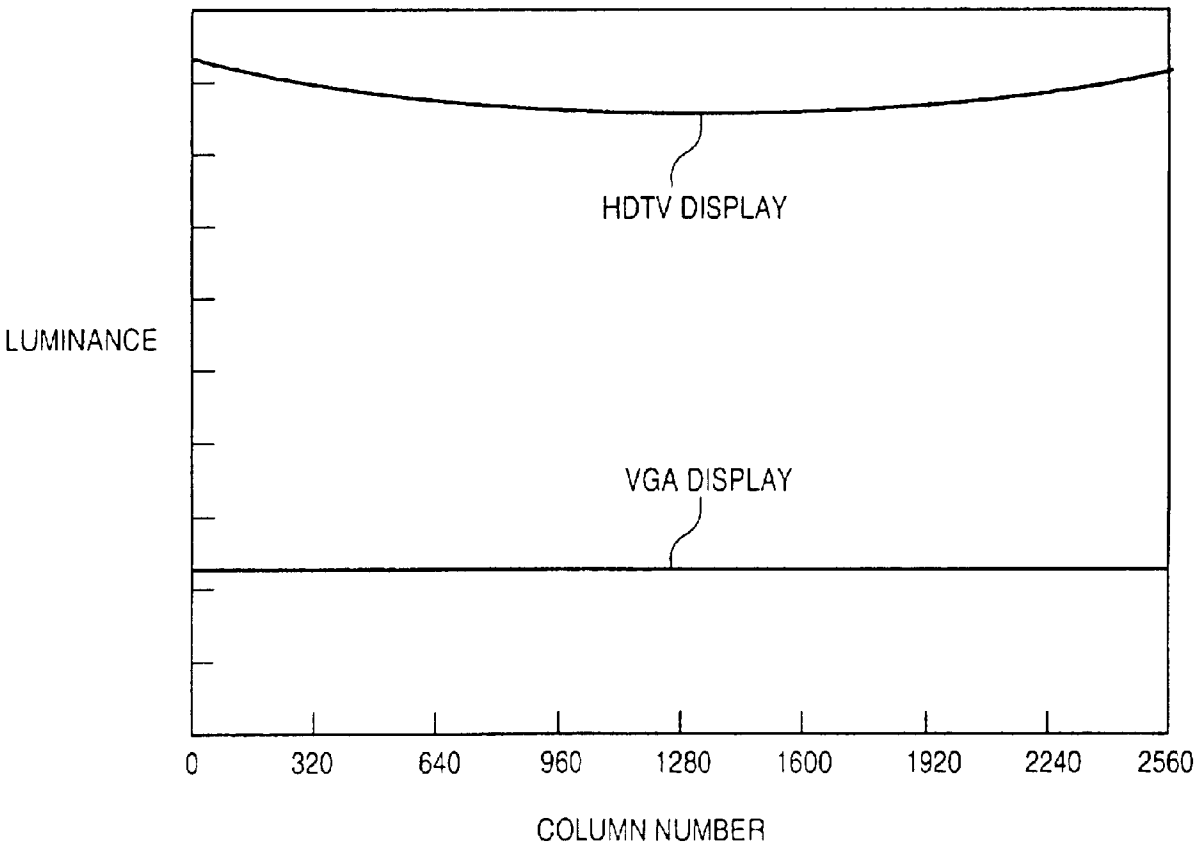
FIG. 6 is a graph showing the luminance distribution when a whole white pattern (R:100%, G:100%, B:100%) is displayed by a display circuit according to the first embodiment of the present invention.

On this display panel, HDTV and VGA signals were selected as video sources to display for each signal a whole white pattern (R:100%, G:100%, B:100%, i.e., modulated signals on all the columns have a maximum pulse width). Then, the luminance of the display panel was measured to obtain the results in FIG. 6. In FIG. 6, the abscissa represents the column number, and the ordinate represents the luminance. The luminance of the display panel is extracted and plotted along the abscissa. The ordinate adopts an arbitrary unit because the luminance changes depending on even the characteristics of the fluorescent substance and the characteristics of the metal back.

As shown in FIG. 6, driving is done at a lower driving voltage in the VGA display mode than in the HD display mode. This suppresses the whole luminance.

Figure 7:
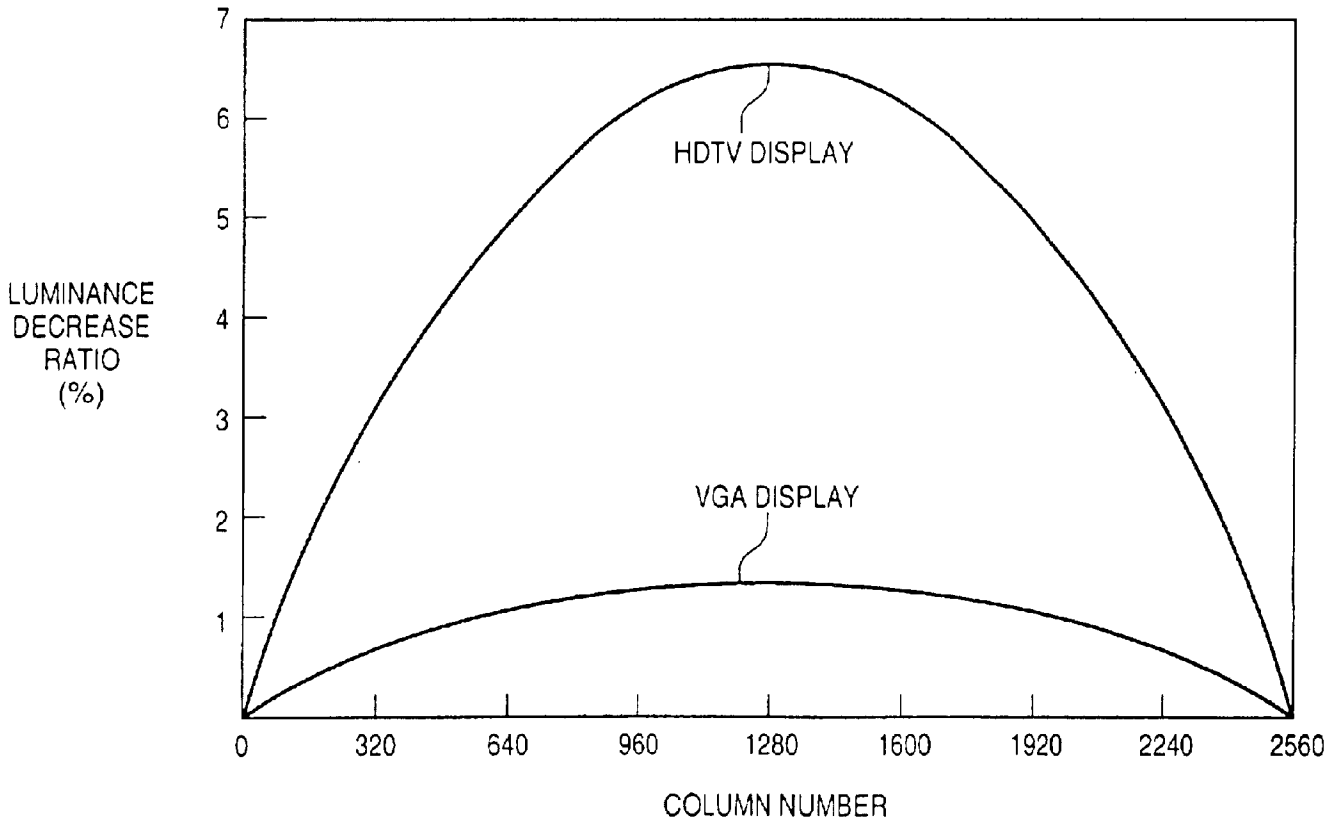
FIG. 7 is a graph showing the luminance decrease ratio when the whole white pattern (R:100%, G:100%, B:100%) is displayed by the display circuit according to the first embodiment of the present invention.

The luminance decrease ratio on the entire screen upon displaying the whole white pattern is shown in FIG. 7. As shown in FIG. 7, when the HD display mode is selected, the luminance decreases about 6.5% at the center of the screen in comparison with the two ends of the screen. To the contrary, in the VGA display mode, the in-plane luminance distribution is suppressed to about 1.2% at the center and two ends of the screen.

Since the voltage drop caused by the wiring resistance maximizes upon displaying the whole white pattern, the in-plane luminance distribution takes at least a smaller value than 1.2% upon displaying another pattern. Even if the above-mentioned window is displayed, the in-plane luminance distribution can be reduced to 1.2% or less even on an unnatural pattern generated at the boundary of the horizontal line of the window.

The present inventors actually displayed an image on this image display apparatus. When an HDTV signal was displayed, an image having a wide dynamic range could be displayed with reality. When a VGA signal was displayed, an unnatural pattern caused by the voltage drop on the wiring was hardly confirmed, and the image display apparatus could attain satisfactory characteristics as the output monitor of the computer.

In the first embodiment, the voltage on the modulation means side is set in accordance with a video source selection state. However, the present invention is not limited to this, and can obtain the same effects even when the selection voltage source Vs on the scanning wiring side is used as a variable voltage source, and the value of the source Vs is changeable in accordance with a video source selection state.

In the first embodiment, the amplitude is set by the two power sources VX1 and VX2 in FIG. 1. However, the present invention is not limited to this, and the amplitude can be similarly set even by changing an output from one variable voltage source.

The first embodiment has exemplified a computer output such as a VGA signal, and a television signal such as an HDTV or NTSC signal, and changes the driving conditions of the former and latter. However, the present invention is not particularly limited to this, and may set different driving voltages in accordance with various video formats.

In the first embodiment, driving conditions are changed in accordance with a selected video format, but may be changed in accordance with video contents.

For example, the driving voltage is set high in displaying an image with reality such as a sport program, and is set low in displaying a movie. This change allows the user to easily change the mode by issuing an instruction to the controller using the remote controller shown in FIG. 1.

When an image was displayed by changing the driving voltage in accordance with video contents, images complying with various video contents could be provided to the user.

A circuit for discriminating the type of image signal to be displayed may be adopted to switch the controller in accordance with the discrimination result. As the discrimination circuit, the present invention can use a circuit of extracting the characteristics of an input signal (e.g., the number of scanning lines, the number of sync signals, and sync signal timings) and discriminating the type of image signal based on the characteristics.

Second Embodiment

The second embodiment concerns an example of modulation using a voltage amplitude-modulated signal as a modulated signal in order to obtain a desired image in a display apparatus having many surface-conduction type emission devices.

Figure 8:
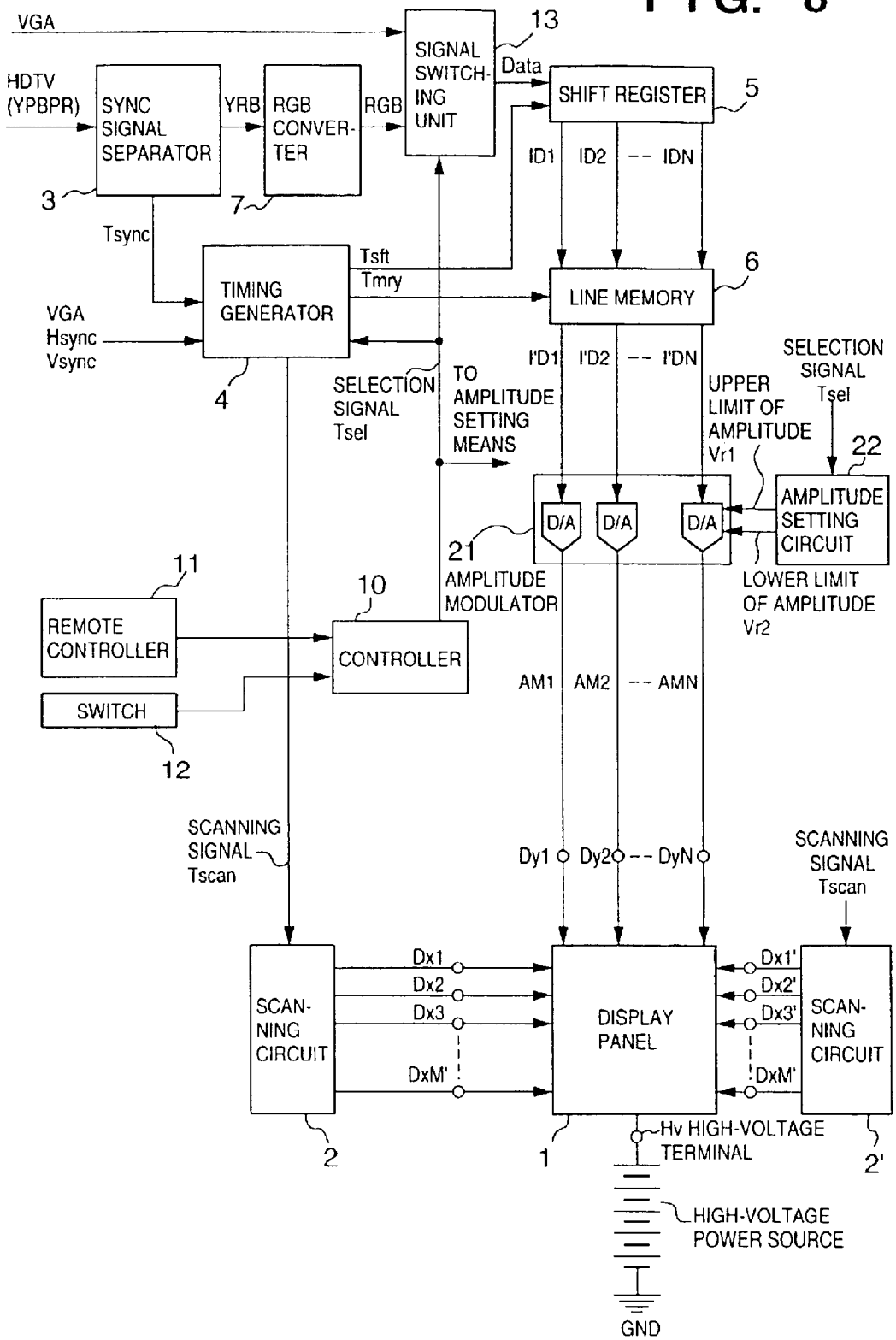
FIG. 8 is a block diagram for explaining an image display apparatus according to the second embodiment of the present invention.

FIG. 8 is a block diagram schematically showing a circuit arrangement. The second embodiment employs an amplitude modulator 21 instead of the pulse width modulator 8 in the first embodiment.

Amplitude Modulator and Amplitude Setting Circuit

Image data separated by a sync signal separator 3 is serial/parallel-converted by a shift register 5, and stored in a line memory 6 during one horizontal scanning period. The amplitude modulator 21 D/A-converts the image data stored in the line memory 6 to output amplitude-modulated potential signals AM1 to AMN. Two outputs Vr1 and Vr2 of an amplitude setting circuit 22 are connected to the reference terminal of a D/A converter. The amplitudes (potential values) of the amplitude-modulated potential signals AM1 to AMN are modulated between minimum and maximum amplitudes Vr2 and Vr1 in accordance with image data, and supplied to respective column wirings.

In the second embodiment, the output potential Vr1 and Vr2 of the amplitude modulator 21 are set to two different potentials in accordance with a selected video source. For example, when the video signal is a natural image such as an HDTV signal, the output potentials are set to Vr1=15 V and Vr2=10 V; and when the video signal is a computer output such as a VGA signal, the output potentials are set to Vr1=13.5 V and Vr2=10 V.

As described above, a computer output image is generally displayed at a low luminance as a whole because the user directly watches the monitor. To suppress the luminance of the entire screen, for example, the accelerating potential Va, driving voltage application time, or application voltage is reduced.

The present inventors have examined these methods to find that it is optimal to reduce the driving voltage (driving voltage for driving the device) applied to the display panel.

This is because a lower driving voltage Vf applied between the row and column wirings of the display panel reduces a current flowing through the row and column wirings. A smaller current flowing through the wiring can reduce the voltage drop on the wiring. This can preferably reduce the above-described image unnaturalness.

If the application time is shortened without reducing the driving voltage, the voltage drop caused by the wiring resistance cannot be reduced, so the above-described image unnaturalness cannot be reduced.

In displaying a natural image represented by an HDTV signal or another television signal, driving is done at a higher driving voltage than in the computer display mode. Thus, an image can be displayed with reality at high luminance.

On this display panel described in the first embodiment, HD and VGA signals were selected as video sources by the driving circuit to display for each signal a whole white pattern (R:100%, G:100%, B:100%, i.e., modulated signals on all the columns have a maximum pulse width). Then, the luminance of the display panel was measured to obtain the results in FIG. 6. In FIG. 6, the abscissa represents the column number, and the ordinate represents the luminance. The luminance of the display panel is extracted and plotted along the abscissa. The ordinate adopts an arbitrary unit because the luminance changes depending on even the characteristics of the fluorescent substance and the characteristics of the metal back.

As shown in FIG. 6, driving is done at a lower driving voltage in the VGA display mode than in the HD display mode. This suppresses the whole luminance.

The luminance decrease ratio on the entire screen upon displaying the whole white pattern is shown in FIG. 7. As shown in FIG. 7, when the HDTV display mode is selected, the luminance decreases about 6.5% at the center of the screen in comparison with the two ends of the screen. To the contrary, in the VGA display mode, the in-plane luminance error is suppressed to about 1.2% at the center and two ends of the screen. Since even the driving method of this embodiment maximizes the voltage drop caused by the wiring resistance upon displaying the whole white pattern, the in-plane luminance error takes at least a smaller value than 1.2% upon displaying another pattern. Even if the above-mentioned window is displayed, the in-plane luminance error can be reduced to 1.2% or less even on an unnatural pattern generated at the boundary of the horizontal line of the window.

The present inventors actually displayed an image on this image display apparatus. When an HDTV signal was displayed, an image having a wide dynamic range could be displayed with reality. When a VGA signal was displayed, an unnatural pattern caused by the voltage drop on the wiring was hardly confirmed, and the image display apparatus could attain satisfactory characteristics as the output monitor of the computer.

Note that the amplitude setting circuit (means) 22 of the second embodiment adjusts the amplitude in amplitude modulation by adjusting the reference potential of the amplitude modulator (means) 21. However, the present invention is not limited to this. For example, the amplitude modulator (means) 21 modulates the amplitude using a D/A converter having a fixed reference voltage, and the amplitude setting circuit 22 adjusts the amplitude using an amplifier capable of setting two gains and two offsets. Also in this case, the same effects could be obtained.

The second embodiment has exemplified a computer output such as a VGA signal, and a television signal such as HDTV and NTSC signals, and changes the driving conditions of the former and latter. However, the present invention is not particularly limited to this, and different driving voltages may be set in accordance with various video formats.

In the second embodiment, driving conditions are changed in accordance with a selected video format, but may be changed in accordance with video contents.

For example, the driving voltage is set high in displaying an image with reality such as a sport program, and is set low in displaying a movie. This change enables the user to easily change the mode by issuing an instruction to the controller using a remote controller shown in FIG. 7, and controlling respective units by the controller.

In this manner, modes complying with images the user wanted to display were prepared, and an image was displayed in each mode while changing a voltage for driving the display panel. Then, images complying with various video contents could be provided to the user.

Third Embodiment

When the above-described image display apparatus displays a natural image represented by the above-mentioned HDTV signal or another TV signal, the user can enjoy a wide-dynamic-range image with reality. When the apparatus displays a computer image represented by a VGA signal, the user hardly perceives any unnatural pattern caused by the voltage drop on the wiring. The apparatus can attain satisfactory characteristics as the output monitor of the computer.

The present inventors have examined an application to an image display apparatus having a display panel in which electroluminescent devices (EL) were arranged in a simple matrix structure as the image display device of the display panel. As a result, the same effects as described above could be obtained.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus, comprising:

row wiring;

a plurality of column wirings;

a modulator;

a plurality of display devices, said plurality of display devices being commonly connected to said row wiring, each of said plurality of column wirings being connected to a corresponding one of said plurality of display devices, and said modulator supplying a modulated signal to said column wirings, wherein said modulator includes:

a pulse width modulator for generating a pulse signal having a time width corresponding to a tone of a signal to be displayed; and a potential setting circuit for setting a potential of the pulse signal in accordance with display modes, and external setting means for setting the potential of the pulse signal in accordance with an image to be displayed, wherein said potential setting circuit sets the potential of the pulse signal in accordance with a setting of said external setting means.

2. An image display apparatus, comprising:

row wiring;

a plurality of column wirings;

a modulator; and a plurality of display devices, said plurality of display devices being commonly connected to said row wiring, each of said plurality of column wirings being connected to a corresponding one of said plurality of display devices, and said modulator supplying a modulated signal to said column wirings, wherein said modulator includes:

a pulse width modulator for generating a pulse signal having a time width corresponding to a tone of a signal to be displayed; and a potential setting circuit for setting a potential of the pulse signal in accordance with display modes, wherein said potential setting circuit sets the potential of the pulse signal in accordance with whether the signal to be displayed is a computer image signal or a television image signal.

3. An image display apparatus, comprising:

row wiring;

a plurality of column wirings;

a modulator; and a plurality of display devices, said plurality of display devices being commonly connected to said row wiring, each of said plurality of column wirings being connected to a corresponding one of said plurality of display devices, and said modulator supplying a modulated signal to said column wirings, wherein said modulator includes:

a peak value modulator for generating a signal having a peak value corresponding to a tone of a signal to be displayed; and a peak value setting circuit for setting an upper limit of the peak value in accordance with display modes.

4. The apparatus according to claim 3, wherein a longitudinal direction of said column wiring crosses a longitudinal direction of said row wiring.

5. The apparatus according to claim 3, wherein said row wiring includes a plurality of row wirings, a plurality of display devices are connected to each row wiring, and each of said plurality of display devices connected to said row wiring shares a corresponding column wiring with each of a plurality of display devices connected to another row wiring.

6. The apparatus according to claim 5, further comprising a scanning circuit for supplying a scan signal for sequentially scanning said plurality of row wirings.

7. The apparatus according to claim 3, wherein said display device consumes only part of a current flowing into said display device for display.

8. The apparatus according to claim 3, further comprising a plurality of input portions for inputting an image signal to be displayed, and a selector for selecting any one of signals from said plurality of said input portions, wherein said peak value setting circuit sets the upper limit of the peak value in accordance with a selection state of said selector.

9. The apparatus according to claim 3, further comprising a discrimination circuit for discriminating a characteristic of an image signal to be displayed, wherein the upper limit of the peak value is set in accordance with a discrimination result of said discrimination circuit.

10. The apparatus according to claim 3, further comprising external setting means for setting the upper limit of the peak value in accordance with an image to be displayed, wherein said peak value setting circuit sets the upper limit of the peak value in accordance with a setting of said external setting means.

11. The apparatus according to claim 3, wherein said peak value setting circuit sets the upper limit of the peak value in accordance with whether the signal to be displayed is a computer image signal or a television image signal.

12. The apparatus according to claim 3, wherein said display device consumes not more than 80% of a current flowing into said display device for display.

13. The apparatus according to claim 3, wherein said display device is an electron-emitting device.

14. The apparatus according to claim 3, wherein said display device is an electroluminescent device.

15. A method of driving an image display apparatus having row wiring, a plurality of column wirings, a modulator, and a plurality of display devices, the plurality of display devices being commonly connected to the row wiring, each of the plurality of column wirings being connected to a corresponding one of the plurality of display devices, and the modulator supplying a modulated signal to the column wirings, comprising the steps of:

generating a signal having a peak value corresponding to a tone of a signal to be displayed; and setting an upper limit of the peak value in accordance with display modes.

* * * * *

UNITED STATES PATENT AND TRADEMARK OFFICE

CERTIFICATE OF CORRECTION

PATENT NO. : 6,933,935 B2
APPLICATION NO. : 10/241536
DATED : August 23, 2005
INVENTOR(S) : Osamu Sagano et al.

It is certified that error appears in the above-identified patent and that said Letters Patent is hereby corrected as shown below:

Title page, item [56] REFERENCES CITED:

OTHER PUBLICATIONS, under W.P. Dyke, et al., "pp. 89-195" should read --pp. 89-185--.

Signed and Sealed this

First Day of August, 2006

JON W. DUDAS
*Director of the United States Patent and Trademark Office*